United States Patent [19]

Kehrer

[11] Patent Number: 4,995,525

[45] Date of Patent: Feb. 26, 1991

[54] OPEN TOP CONTAINER WITH CONTAINMENT MEANS

[76] Inventor: Lawrence L. Kehrer, Rte. 6, Box 261, Chapel Hill, N.C. 27514

[21] Appl. No.: 391,450

[22] Filed: Aug. 9, 1989

[51] Int. Cl.[5] ..... B65D 51/26

[52] U.S. Cl. ..... 220/85 R; 24/16 PB; 24/300; 206/805; 224/324; 248/499

[58] Field of Search ..... 220/85 R, 326; 206/805; 57/200; 100/914; 24/16 PB, 298, 299, 300, 301, 302; 224/324, 326, 250; 248/499, 500, 503, 505

[56] References Cited

U.S. PATENT DOCUMENTS

| | | | |
|---|---|---|---|
| 1,519,854 | 12/1924 | Lockwood | 24/300 |
| 4,569,108 | 2/1986 | Schwab | 24/300 |
| 4,809,848 | 3/1989 | Rozmestor | 206/805 |
| 4,869,375 | 9/1989 | Lamb | 24/301 |

FOREIGN PATENT DOCUMENTS

| | | | |
|---|---|---|---|
| 2741111 | 3/1979 | Fed. Rep. of Germany | 224/324 |
| 1028058 | 5/1953 | France | 24/300 |
| 1081053 | 12/1954 | France | 248/499 |
| 1132912 | 3/1957 | France | 206/805 |
| 706115 | 5/1966 | Italy | 206/805 |
| 758220 | 11/1956 | United Kingdom | 224/324 |

*Primary Examiner*—George E. Lowrance
*Attorney, Agent, or Firm*—Olive & Olive

[57] ABSTRACT

A container with an opening and having two flexible stretchable cords attached to the upper edges of the container. The central areas of the cords may be releasably attached together over the opening by means of a fastener. When the cords are not attached together, each cord may be stretched over a corner holding means located at or near the corner of the container that is between the ends of that cord.

18 Claims, 4 Drawing Sheets

OPEN TOP CONTAINER WITH CONTAINMENT MEANS

BACKGROUND OF THE INVENTION

1. Field of the Invention

This invention relates to containers for holding items. In particular, this invention pertains to containers that may be used for securely containing recyclable items of various shapes, volumes and types.

2. Description of the Related Art

As resources become more scarce and concern for environmental pollution increases, communities are beginning to adopt waste recycling programs The processes involved in recycling the differing types of wastes, such as bottles of various types of glass, metal cans, and newspapers, require that these different types of waste be sorted by type before reprocessing.

Because people are more likely to utilize waste recycling facilities if the wastes are picked up from their homes and if they do not have to sort the waste, the waste recycling companies in larger cities are beginning to provide waste collection services to residents and to sort the recycled materials after collection. Companies have developed plastic containers for people to use for their recyclable items but it is difficult to provide a single container that conveniently holds both newspapers and mixed recyclable containers of various types, and that is small enough for convenient use in the home while providing an adequate capacity for increased collection efficiency. It is also important that the containers used for recycling items are acceptable in appearance for use in and around homes.

Further, it is difficult to anticipate accurately how much volume a customer will require for that customer's recyclable items, and to provide for the obvious differences in output volume that each customer may experience from collection period to collection period.

Another problem faced by waste recyclers is finding a means of handling stacks of newspapers without tying the newspapers together or putting them in additional containers, such as bags, to avoid losing portions of them in windy weather even if the container is not full.

Another problem in waste recycling is providing means of containment that secure the recyclable items, but allow easy addition of other recyclable items as well as stacking of nested empty containers for efficient shipping and storage.

It is therefore an object of this invention to provide a container that may be used for waste recycling of newspapers as well as glass, metal or other items of varied shapes, sizes, and quantities.

It is a further object of this invention to provide a container that may be used to contain and hold securely varying amounts of recyclable items and to which additional contents may easily be added, thereby reducing the number of containers that the person who is recycling items needs to handle and increasing the efficiency of the waste recycling process.

It is a further object of this invention to provide a container with a top having a releasable means that may be either used to hold contents in the container or may be held securely away from the opening of the container, so that the container may be filled, emptied, or stacked with other containers.

Another object of the invention is to provide a container that securely contains recyclable items and that may be stored in multiple lots without taking up substantial amounts of space.

Another object of the invention is to provide a container that is visually pleasing without excessive amounts of cords or other pieces to be handled by the recycler Another object of the invention is to provide a container that may be used to hold newspapers or other items without strapping or tying the items together.

Other objects and advantages will be more fully apparent from the following disclosure and amended claims.

SUMMARY OF THE INVENTION

The invention comprises a container with an opening and having two flexible stretchable cords, which are each attached at their ends to the upper side edges of the container. The central areas of the cords may be releasably attached together over the opening by means of a fastener. When the cords are not attached together, each cord may be stretched over a corner holding means located at or near the corner of the container that is between the ends of that cord.

Other aspects and features of the invention will be more fully apparent from the following disclosure and appended claims.

DETAILED DESCRIPTION OF THE INVENTION AND PREFERRED EMBODIMENT THEREOF

Figure 1:
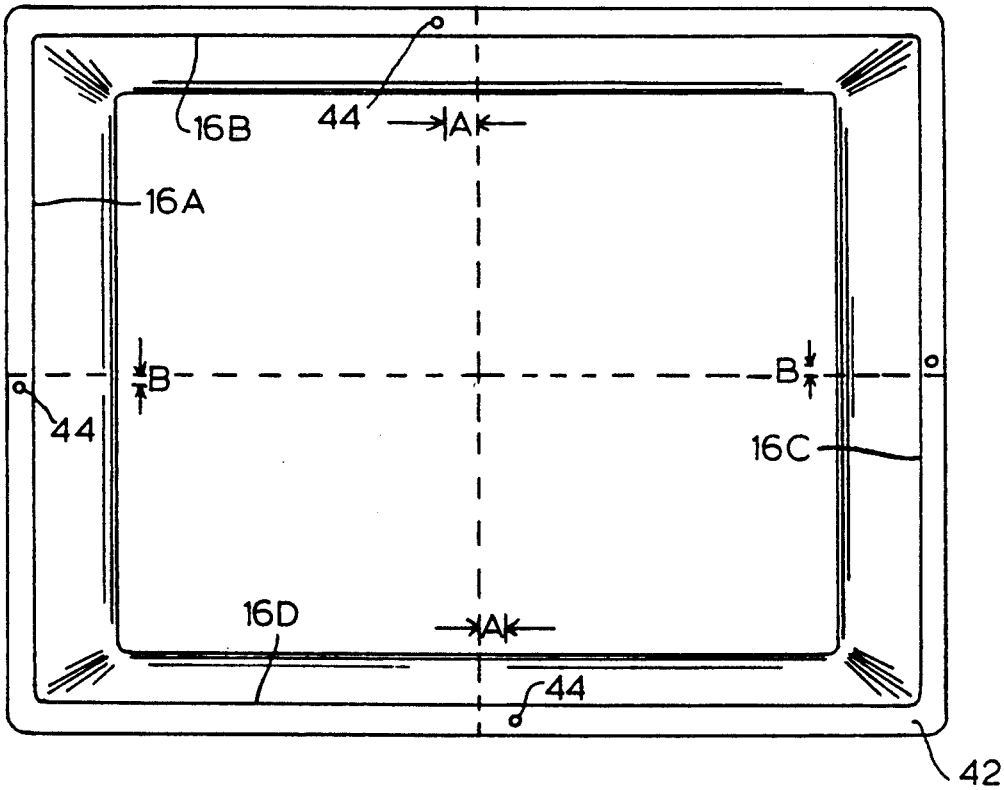
FIG. 1 is a schematic diagram of a view of the top of a container according to the invention, showing preferred measurements for one embodiment.

The present invention comprises an open top container. In its preferred embodiment the container of the invention is of a size, shape and material that may be used for holding a variety of recyclable materials and has releasable, stretchable means to hold the contents in the container.

In particular, the container 10 of the invention comprises:

(a) a receptacle 12 having an upper rectangular opening 14 with four edges 16A–D, four corner areas 18A–D, and a central area 20;

(b) a first elongated element 22 and a second elongated element 24, each of said elongated elements made of flexible, stretchable material having a first end and a second end, the first end 26 of said first elongated element 22 attached to a first edge 16A of the upper rectangular opening 14 and the second end 28 of said first elongated element 22 attached to a second edge 16B of the upper rectangular opening 14 that is perpendicular to the first edge 16A, the first end 30 of said second elongated element 24 attached to a third edge 16C of said upper rectangular opening 14 and the second end 32 of said second elongated element 24 attached to a fourth edge 16D of the upper rectangular opening 14;

(c) a means for releasably fastening said first elongated element 22 to said second elongated element 24 over the central area 20 of said rectangular opening 14; and (d) a means for releasably holding each of said elongated elements 22, 24 to the corner area 18A, C located between the ends of said elongated element.

For recycling of wastes, a preferred receptacle 12 comprises a medium to light-weight, molded plastic container such as the HUSKY*TM* plastic container that is made by Rehrig Pacific Company (Los Angeles, CA). The HUSKY*TM* container has the typical upper dimensions of about 53 by 40 cm (outer, upper dimensions) and about 50 by 37 cm (inner upper dimensions) with sides 34 being about 32 cm high and gently tapered upward and outward from the bottom 36. This allows a household's recyclable waste items, including newspapers to be piled into the containers 10 for collection by the recycling company or delivery to a recycling facility. Multiple empty containers may be stacked inside each other when not in use. These HUSKY TM containers have a lip that extends around the top of the container and extends outward about 1 cm and downward about 2 cm. This lip provides a convenient place for attachment of the elongated elements 22,24 of the invention as discussed below.

Containers 10 of other sizes and dimensions or containers that may be used for differently sized contents and that have proportionately different lengths of flexible elongated elements 22,24 (see discussion below) to hold the contents 38 in the containers comprise other embodiments within the scope of the invention. Containers may be made of any material in addition to molded plastic, for example, other types of plastic fabrication or other materials, as long as the material is sturdy enough to hold the desired contents and to hold the elongated elements.

The preferred flexible elongated elements 22,24 comprise sections of stretchable woven, knitted or braided cord, or other stretchable materials such as rubber or rubber-like substances, that are sturdy and durable enough to withstand repeated and prolonged stretching (FIG. 2) and retain the capability for stretching. An example of such a cord comprises a woven nylon covering formed over a round latex rubber core, such as shock cord sold for holding items on bicycles, such as that made by American Cord and Webbing (New York, NY). Cords with an approximate diameter of slightly less than or about 0.5 cm (about 3/16 inch) and the capacity of stretching about 1½ to about 2½ times their unstretched length are preferred for use with recycling containers of the sizes discussed above usable for waste recycling containers. This enables excess contents 40, for example, a stack of newspapers on top of other recyclable items, to be held in the container (FIG. 3). Other materials with the appropriate durability and capability for stretching, and narrower or wider sections of stretchable material may be used for the elongated elements for a particular container and type of contents.

Figure 2:
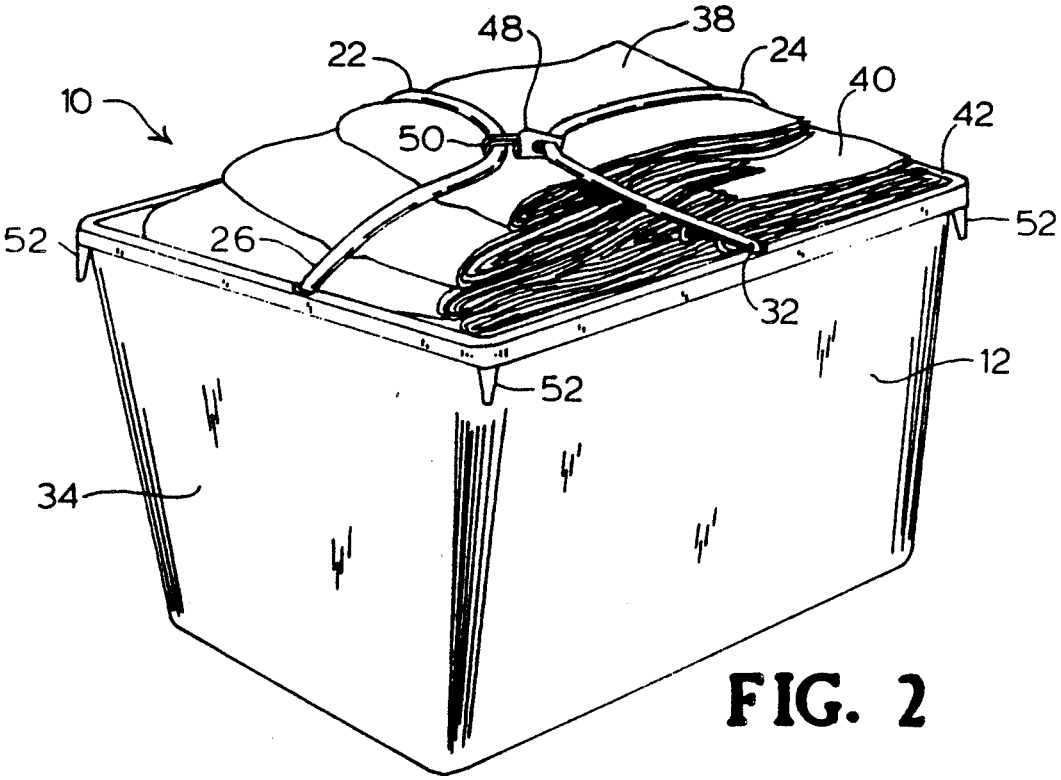
FIG. 2 is a perspective side view of the container of the invention showing the cords stretched above the receptacle contents.
Figure 3:
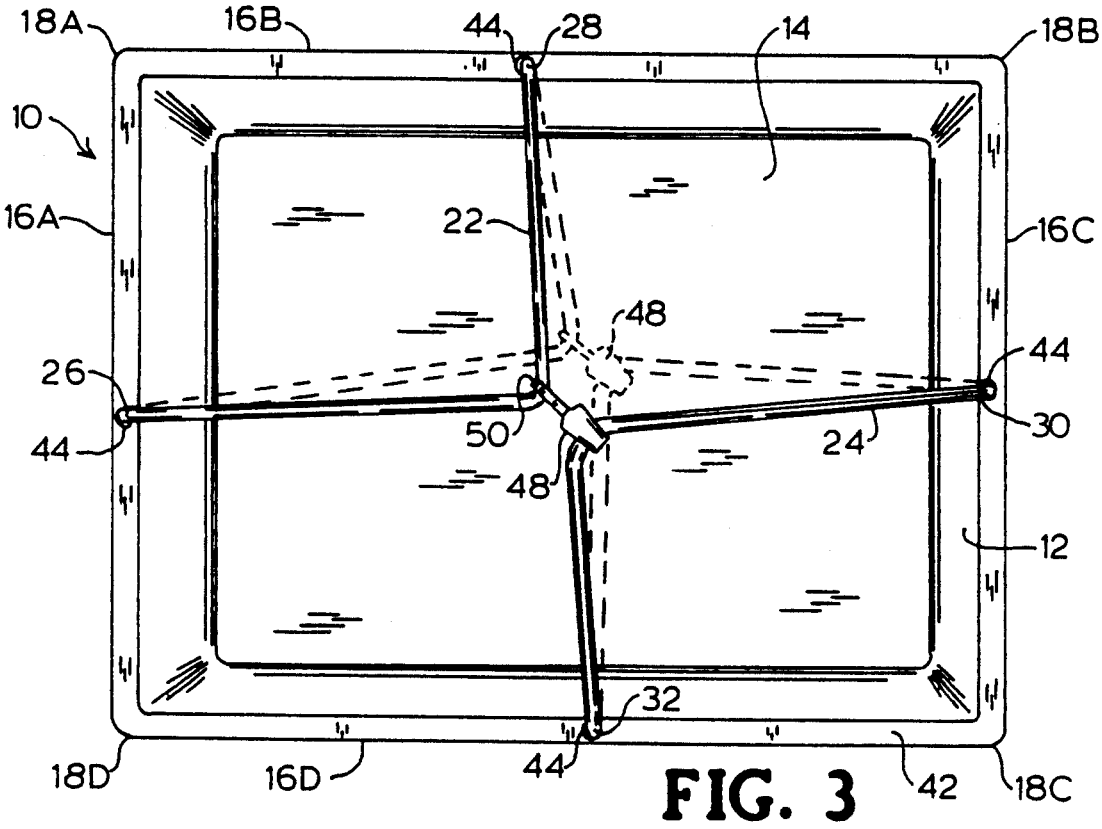
FIG. 3 is a perspective view of the top of a container according to the invention showing cords held together by a fastening means and showing two alternate positions for holding the cords together.

The ends 26,28,30,32 of these elongated elements are attached to the central portion of the upper edges 16A–D of the lips 42 of adjacent perpendicular sides 34 of the receptacle 12 (FIGS. 1 and 2). To enable this attachment, the upper edge or a lip 42 around the edge may have a hole 44 on each side for insertion of the elongated elements. The diameter of the hole should be about the same size or slightly larger than the diameter of the elongated elements. In the example of the waste receptacle discussed above, a useful hole 44 has a diameter of about 0.5 cm.

Figure 9:
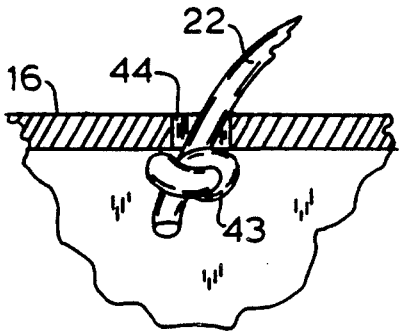
FIG. 9 is a cross-section of a closeup view of the knotted end of an elongated element extending through a hole on a container according to one embodiment of the invention.

The means of attachment may comprise extending each end of the elongated element through the hole 44 in an upper lip 42 along the edge of the receptacle and having a knot 43 (FIG. 9) in each of the ends of the elongated element on the underside of the lip area around the upper edge of the receptacle. Alternatively, an object having a larger diameter than the hole may be attached toward or at each end of the cord to hold it to the upper edge of the container and keep the end of the cord from slipping through the hole.

Figure 5:
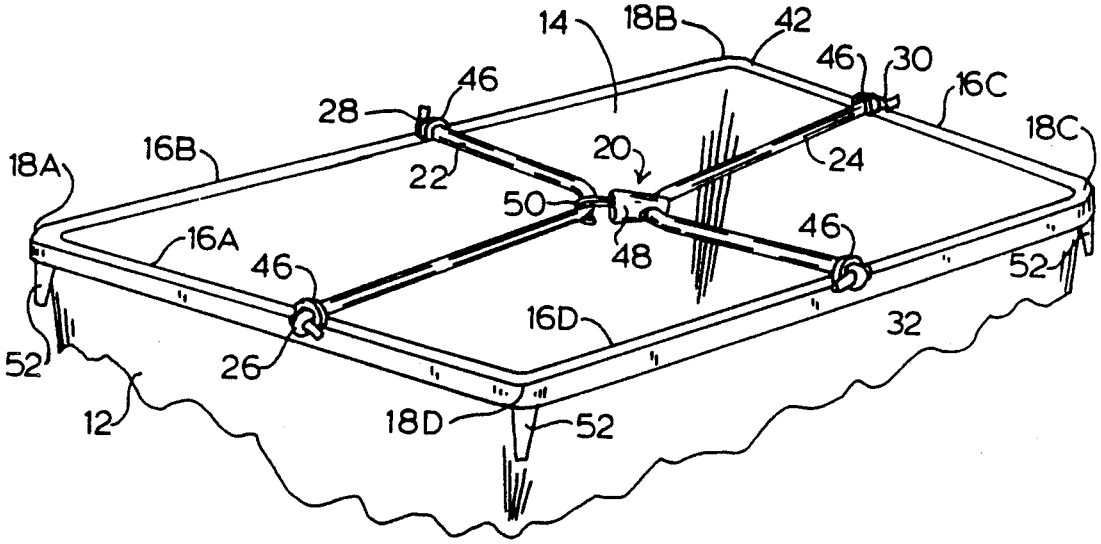
FIG. 5 is a perspective view of the top of the container of the invention showing the alternate use of loops instead of holes to hold the ends of the cords.

Other means of attachment of the cords to the receptacle may also be used. As shown in FIG. 5 for example, the cord may be held to the appropriate edge area by means of a looped structure 46 at each of the appropriate positions along the upper edge or lip 42 of the receptacle. If the container does not have a lip 42 around the upper edge, the elongated element may be attached by any type of fastening means near the upper edge of the container at an appropriate area near the center of the upper edge of the side of the container.

Figure 4:
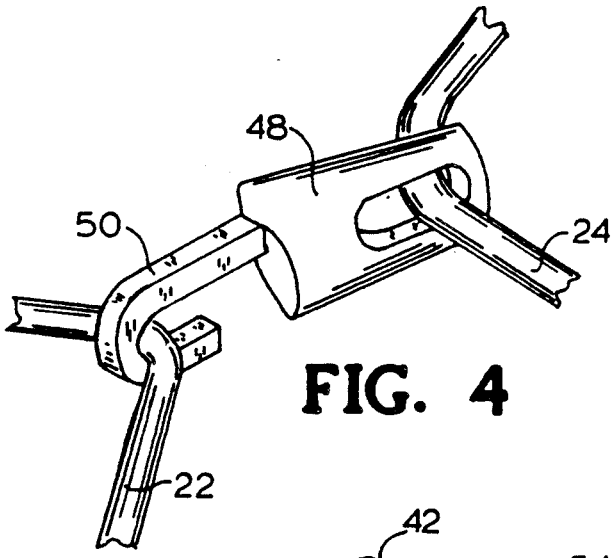
FIG. 4 is a perspective view of a fastener that may be used in the invention.

A releasable fastening means 48 (FIG. 4) is used to hold the central portions of each elongated element together over the opening 14 and over any receptacle contents 38 in the receptacle. Preferably, the fastening means 48 is permanently but movably attached to one cord so that it does not fall off or become misplaced, and is releasably attachable to the other cord. The fastening means 48 may in the alternative, be permanently and unmovably attached to one of the elongated elements, and releasably attachable to the other elongated element. Having the fastening means 48 attached in a movable fashion to each cord element enables the position of the cords over the top of the receptacle to be adjusted (for example, between positions as shown in FIG. 5, as well as enabling ease of attachment of the two cords to each other. The term "permanently attached" with respect to the fastening means 48 and an elongated element includes a fastener that may be locked on to and unlocked from the elongated element, but does not include a fastener that easily falls off or otherwise becomes detached from both cords.

A preferred fastening means 48 is a hook shaped as shown in FIG. 5 that is used with shock cord and is made by American Cord and Webbing, New York, NY, but any releasable fastener may be used. Such a preferred fastener has a first end and a second end, and said first end comprises a loop and said second end has a completely enclosed hole attachment means. The dimensions of the preferred fastener for the waste recycling container shown in FIG. 1 are about 4 cm long by about 1½ cm in width at the widest point. The hook size and style may be varied depending on the size of cord used and the size of container, or to vary the appearance of the container, as long as the fastening means may be permanently attached to one elongated element and the open end 50 fits over the cord being used.

The elongated elements 22,24 are releasably attached together by grasping the fastening means 48 attached to one cord and looping the open end 50 of the fastening means 48 over the remaining cord over the central area 20 of the receptacle 12. Release of the attachment only requires slipping the releasaby attached cord from the open end 50 of the fastening means 48.

It is preferable to have the length of the elongated elements 22,24 (cords) be somewhat less than half the sum of the lengths of the two sides to which it is attached, and to have the attachment holes slightly offset from the center of these two sides as shown in the example in FIG. 1 where the distances between the edge of the hole on the shorter side of the container and the edges 16B and 16D may be about 17.5 cm and 19 cm, respectively, and the distances between the edge of the hole on the longer side of the container and edges 16A and 16C may be about 27 cm and 22.5 cm, respectively. The length of the cord is also preferably greater than the distance along the receptacle edge between the holes through which that cord extends (or other fastening elements on side of the container). This allows the fastener, when fastened to both cords to hold the cords taut but not stretched when the container is not filled to the top, and to extend between the cords when attached to them, and also allows the cords to stretch easily over the outside lip but be held taut but not stretched by the means for releasably holding the elongated elements to the corner area when they are not fastened together.

In this preferred arrangement of a container of the size shown in FIG. 1, the unstretched length of each cord between the attachment holes 44 is about 42½ cm. This length is thus preferably less than half the sum of the lengths of the two sides to which it is attached (which is about 46½ cm) and slightly longer (in this example about 1 cm) longer than the distance between the holes in which that elongated element is held.

Preferably the attachment holes 44 or other means for holding the ends of the elongated elements to the sides of the receptacle are offset from the center (shown in dotted lines in FIG. 1) as follows: the hole 44 along the longer side of the container is offset by a distance A from the center of that side toward the corner between the two holes for that elongated element, and the hole along the shorter side of the container is offset by a distance B from the center of that side away from the corner between the two holes for that elongated element. The net distance, defined as the difference between A and B causes the cord to be shifted in location from the center of the receptacle. The preferred net distance for offsetting the two holes for each cord for a container of the size shown in FIG. 1 is about half the distance between the central areas of the two cords when they are centrally fastened together (which is determined by the length of the fastening means 48). Another practical reason for offsetting the holes in the preferred recycling container of the invention is that the HUSKY*TM* container has a central depression at each side (not shown) that interferes with central placement of the hole.

Although the holes should be offset, it is preferable that they be as close to the center as possible, to enable the cords to both stretch over the corners and to attach in the center in a manner so that when the cords are fastened together, they are spaced approximately equally across the center of the receptacle to best hold the contents of the container in the container.

The important considerations for determining the location of the holes and the length of the elongated elements are: (1) the presence of extent of lip on the container and the effective length of the fastening means (the distance between the areas of the cords being held by the fastening means) when the two elongated elements are held together.

The amount of offset of one hole from the center of the side on which the hole is located may be increased or decreased, and the offset of the other side decreased or increased, respectively to attain the same desired characteristics of the elongated elements. Other adjustments in the location of the holes and/or the length of the cord may be made if the container has a larger or smaller lip or no lip. If the holes are in the exact center of the appropriate sides and the cords are of the correct length to hook to each other without being stretched tightly or hanging loosely, the cord is too short for easy hooking over the corner of the container; and if the cord is long enough for hooking over the corner of the container, it hangs too loosely to be hooked together firmly to the other cord (when the container is not full).

Figure 6:
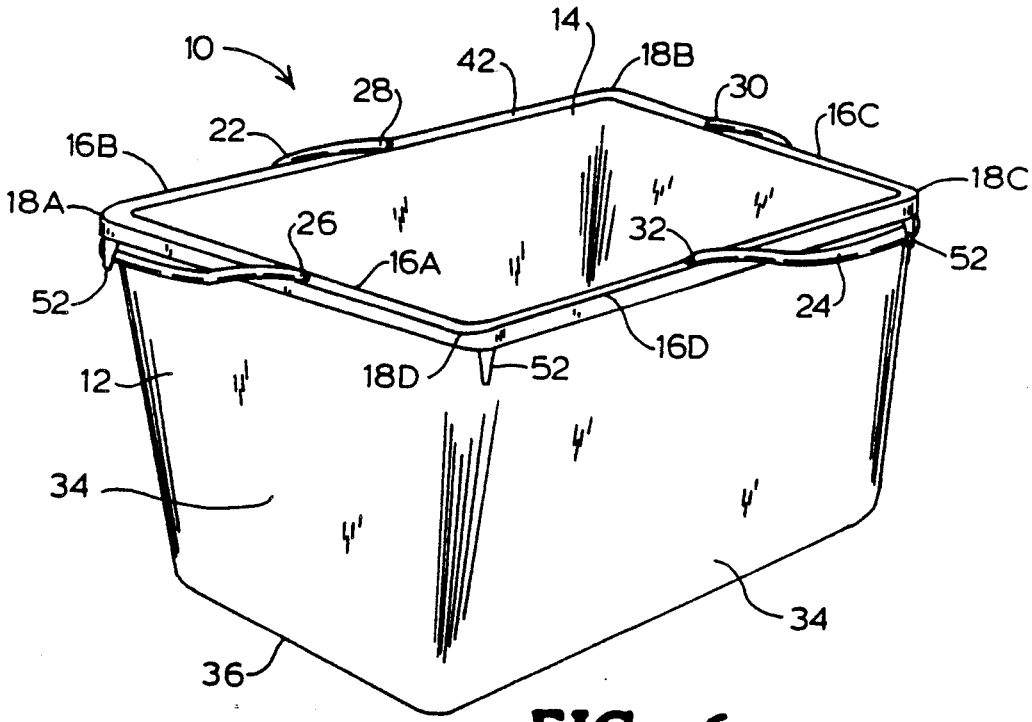
FIG. 6 is a perspective view of a first embodiment of the top of the container according to the invention showing the cords being held away from the receptacle opening by means of downward corner flanges.

The means for releasably holding the elongated elements to the corner area may comprise a downward flange 52 on the corner 18 between the two ends of the element in question Such downwardly extending flanges 52 are found at each corner of the HUSKY TM receptacle discussed earlier (FIG. 6).

Figure 7:
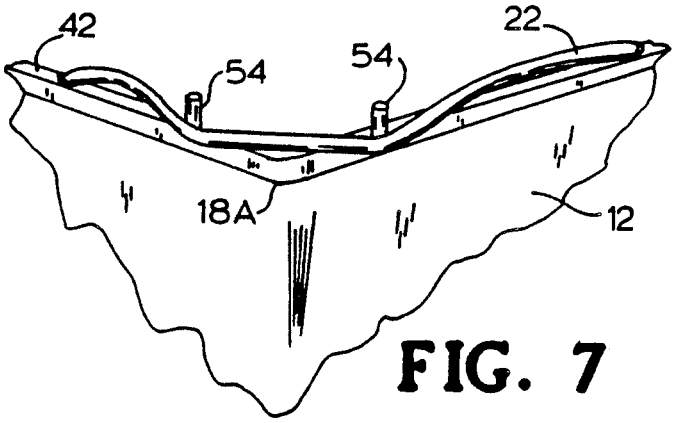
FIG. 7 is a partial perspective view of a second embodiment of the top of the container showing a corner holding means.

Alternatively, one or more upward or outward projections 54 at the corner between the ends may be used to hold each elongated element 22,24 out of the way for filling or stacking of the receptacle 12 (FIG. 7). In this embodiment, the length of the elongated elements may not need to be greater than the distance along the edge of the receptacle between the places (holes) where the cord ends are attached to the edge, because the cord does not need to extend down over the edge to be hooked on the projections 54.

Figure 8:
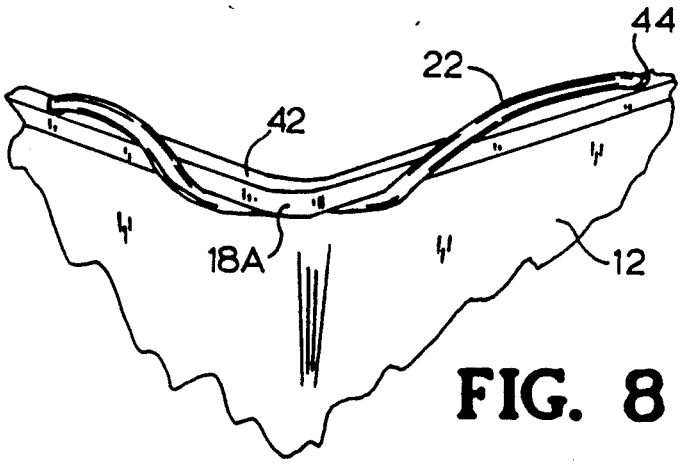
FIG. 8 is a partial perspective view of a third embodiment of the top of the container showing the lip serving as a corner holding means.

In a third embodiment of the invention, if the receptacle does not have special flanges at the corner for holding the elongated elements 22,24, the lip of the container receptacle may serve to hold the elongated elements out of the way for loading, unloading and stacking the containers, although the elongated elements are more likely to be accidentally disengaged from the corner if they are not held by one or more of flanges as discussed above (FIG. 8).

Figure 10:
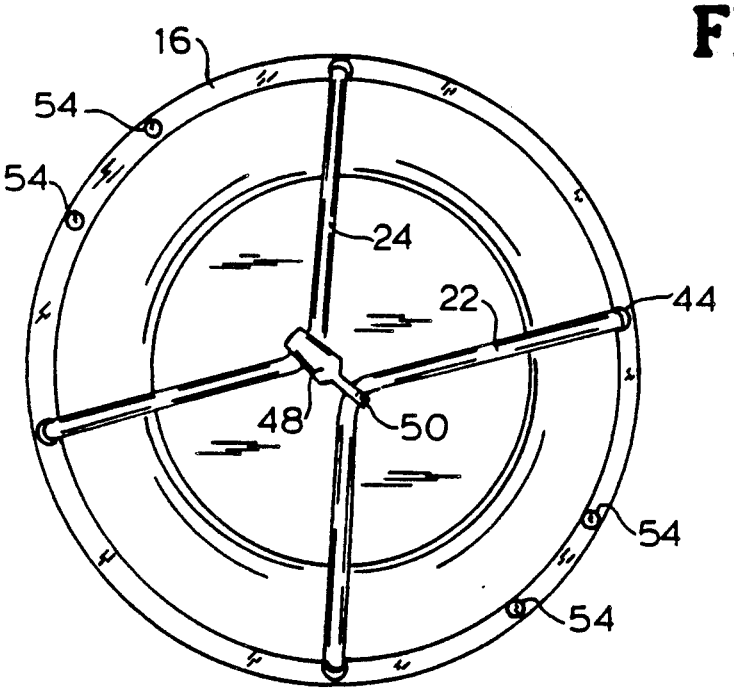
FIG. 10 is a perspective top view of a fourth embodiment of the invention.

A fourth embodiment of the invention is shown in FIG. 10 and comprises a receptacle with a rounded upper area. In this embodiment, the type of means for releasably fastening the elongated elements together is the same as in the other embodiments. The means for releasably holding each of the elongated elements to the edge of the rounded receptacle comprises flanges, protruding elements or other fastening means located along the upper edge of the receptacle approximately halfway between the ends of the appropriate elongated element. The length of the elongated elements is again adjusted so that the two elongated elements may be held together tautly, or may be fastened away from each other over the means for releasably holding the elongated elements to the side. This length would be slightly less than the diameter of the upper area. In determining the position of attachment of the elongated elements to the circumference, the length of the arc of the circumference between the ends of the elongated element should be slightly less than the length of the elongated elements if the means for releasably fastening the elements to the other edge are below the lip. This is preferred so that the containers may be stacked.

While the invention has been described with reference to specific embodiments thereof, it will be appreciated that numerous variations, modifications, and embodiments are to be regarded as being within the spirit and scope of the invention.

What Is claimed Is:

1. A container, comprising:

(a) a receptacle having an upper rectangular opening with four edges, four corner areas, and a central area;

(b) a first elongated element and a second elongated element, each of said elongated elements made of flexible, stretchable material having a first end and a second end, the first end of said first elongated element attached to a first edge of the upper rectangular opening and the second end of said first elongated element attached to a second edge of the upper rectangular opening that is perpendicular to the first edge, the first end of said second elongated element attached to a third edge of said upper rectangular opening and the second end of said second elongated element attached to a fourth edge of the upper rectangular opening;

(c) a means for releasably fastening said first elongated means to said second elongated means over the central area of said rectangular opening; and (d) a means for releasably holding each of said elongated elements to the corner area located between the ends of said elongated element.

2. A container according to claim 1, wherein the means for releasably holding each of said elongated elements comprises a downwardly extending flange on each corner of the receptacle upper edge that is between the ends of an elongated element.

3. A container according to claim 1, wherein the means for releasably holding each of said elongated elements comprises one or more protruding elements on each corner of the receptacle that is between the ends of an elongated element.

4. A container according to claim 1, wherein the receptacle comprises a molded plastic container.

5. A container according to claim 1, wherein the elongated elements comprise pieces of stretchable cord having knots at each end to hold the ends to the upper edge of the receptacle.

6. A container according to claim 1, wherein the means for releasably fastening said first elongated means to said second elongated means comprises a fastener that is permanently and slidably attached to said first elongated means and is releasably attachable to said second elongated means.

7. A container according to claim 1, wherein the means for releasably fastening said first elongated means to said elongated means comprises a fastener having a first end and a second end, said first end comprises a loop and said second end has a completely enclosed hole attachment means.

8. A container according to claim 1, wherein the ends of said elongated elements are attached to the edges near to but not at a center point on said edges.

9. A container according to claim 1, wherein the length of each of the elongated elements is less than half the sum of the lengths of the edges of the upper rectangular opening to which the elongated element is attached and is greater than a distance along the edges of the receptacle extending between the ends of said elongated element.

10. A container containment mechanism for a receptacle having an upper rectangular opening with four edges, four corner areas, and a central area, comprising:

(a) a first elongated element and a second elongated element, each of said elongated elements made of flexible, stretchable material having a first end and a second end, the first end of said first elongated element attached to a first edge of the upper rectangular opening and the second end of said first elongated element attached to a second edge of the upper rectangular opening that is perpendicular to the first edge, the first end of said second elongated element attached to a third edge of said upper rectangular opening and the second end of said second elongated element attached to a fourth edge of the upper rectangular opening;

(b) a means for releasably fastening said first elongated means to said second elongated means over the central area of said rectangular opening; and (c) a means for releasably holding each of said elongated elements to the corner area located between the ends of said elongated element 11. A container containment mechanism according to claim 10, wherein the means for releasably holding each of said elongated elements comprises a downwardly extending flange on each corner of the receptacle upper edge that is between the ends of an elongated element.

12. A container containment mechanism according to claim 10, wherein the means for releasably holding each of said elongated elements comprises one or more protruding elements on each corner of the receptacle that is between the ends of an elongated element.

13. A container containment mechanism according to claim 10, wherein the elongated elements comprise pieces of stretchable cord having knots at each end to hold the ends to the upper edge of the receptacle.

14. A container containment mechanism according to claim 10, wherein the means for releasably fastening said first elongated means to said second elongated means comprises a fastener that is permanently and slidably attached to said first elongated means and is releasably attachable to said second elongated means.

15. A container containment mechanism according to claim 10, wherein the means for releasably fastening said first elongated means to said elongated means comprises a fastener having a first end and a second end, said first end comprises a loop and said second end has a completely enclosed hole attachment means.

16. A container containment mechanism according to claim 10, wherein the ends of said elongated elements are attached to the edges near to but not at a center point on said edges.

17. A container containment mechanism according to claim 10, wherein the length of each of the elongated elements is less than half the sum of the lengths of the edges of the upper rectangular opening to which the elongated element is attached and is greater than a distance along the edges of the receptacle extending between the ends of said elongated element.

18. A container, comprising:

(a) a receptacle having an upper rounded opening, an upper edge and a central area;

(b) a first elongated element and a second elongated element, each of said elongated elements made of flexible, stretchable material having a first end and a second end, each of said ends attached to the edge of the upper rounded opening;

(c) a means for releasably fastening said first elongated means to said second elongated means over the central area of said rounded opening; and (d) a means for releasably holding each of said elongated elements to the area located between the ends of said elongated element.

* * * * *